United States Patent [19]

Cattaneo

[11] Patent Number: 4,685,645

[45] Date of Patent: Aug. 11, 1987

[54] TABLE LEG WITH SHEATING

[75] Inventor: Carlo Cattaneo, Figino Serenza, Italy

[73] Assignee: Camar S.p.A., Como, Italy

[21] Appl. No.: 719,824

[22] Filed: Apr. 4, 1985

[30] Foreign Application Priority Data

Apr. 6, 1984 [IT] Italy ..... 21464/84[U]

[51] Int. Cl.[4] ..... A47B 13/02

[52] U.S. Cl. ..... 248/188.8; 248/188.4

[58] Field of Search ..... 248/188.8, 188.9, 188.4, 248/165, 150, 529, 188.7, 188; 108/150; 52/727, 728, 725, 731, 311

[56] References Cited

U.S. PATENT DOCUMENTS

| | | | |
|---|---|---|---|
| 83,226 | 10/1868 | Walters | 52/731 |
| 172,126 | 1/1876 | Kelly | 52/731 |
| 758,331 | 4/1904 | Ohnstrand | 108/150 |
| 972,287 | 10/1910 | Swift | 248/188.4 |
| 2,931,128 | 5/1960 | Hiers | 248/188.4 |
| 2,963,131 | 12/1960 | Brockway | 52/731 |
| 3,104,493 | 9/1963 | Nalle | 248/188.4 |
| 3,254,362 | 6/1966 | Rasor | 248/188.4 |
| 3,452,386 | 7/1969 | Carlson | 248/188.9 |
| 3,639,001 | 2/1972 | Anderson | 248/188.8 |
| 3,742,871 | 7/1973 | Kienel | 108/150 |
| 4,015,397 | 4/1977 | Flachbarth | 248/188.4 |
| 4,036,371 | 7/1977 | Michel | 248/188.4 |
| 4,101,231 | 7/1978 | Streib | 248/231.3 |

FOREIGN PATENT DOCUMENTS

| | | | |
|---|---|---|---|
| 1006307 | 9/1965 | United Kingdom | 248/188.8 |

*Primary Examiner*—Reinaldo P. Machado
*Assistant Examiner*—Alvin Chin-Shue
*Attorney, Agent, or Firm*—Finnegan, Henderson, Farabow, Garrett & Dunner

[57] ABSTRACT

A decorative table leg having a cylindrical load bearing central core and a plurality of longitudinal sheathing staves surrounding the outer surface of said core. The staves are held in place by a plurality of perpherally spaced, T-shaped segments integral with the core and projecting radially outward therefrom, the staves having complimentary shaped longitudinal edges for slidably inserting the staves between the segments.

3 Claims, 5 Drawing Figures

TABLE LEG WITH SHEATING

As is well known to those skilled in the art, a table leg must comply with several structural and aesthetic requirements. It must indeed have a structure obtainable at relatively low cost, and at the same time this structure must be able to provide the table with suitable stability and an agreeable aesthetic appearance.

The general object of the present invention is to provide a table leg complying with the above requirements and to this end according to the invention the leg is characterized by load bearing central core, longitudinal sheathing staves being applicable thereto by connecting means.

Said central core can for example be implemented by a segment of box-type section, said connecting means being integral therewith.

Preferably, the connecting means for the staves are segments of T-shaped cross-section radially extending from the box-type section along a generating line and mutually spaced so as to receive said staves by sliding insertion, to this end the longitudinal edges of said staves being suitably shaped.

The structural and functional characteristics of the invention together with its advantages in comparison with the known legs will appear from the following description taken together with the accompanying drawings which illustrate an embodiment of the invention, and in which.

Figure 1:
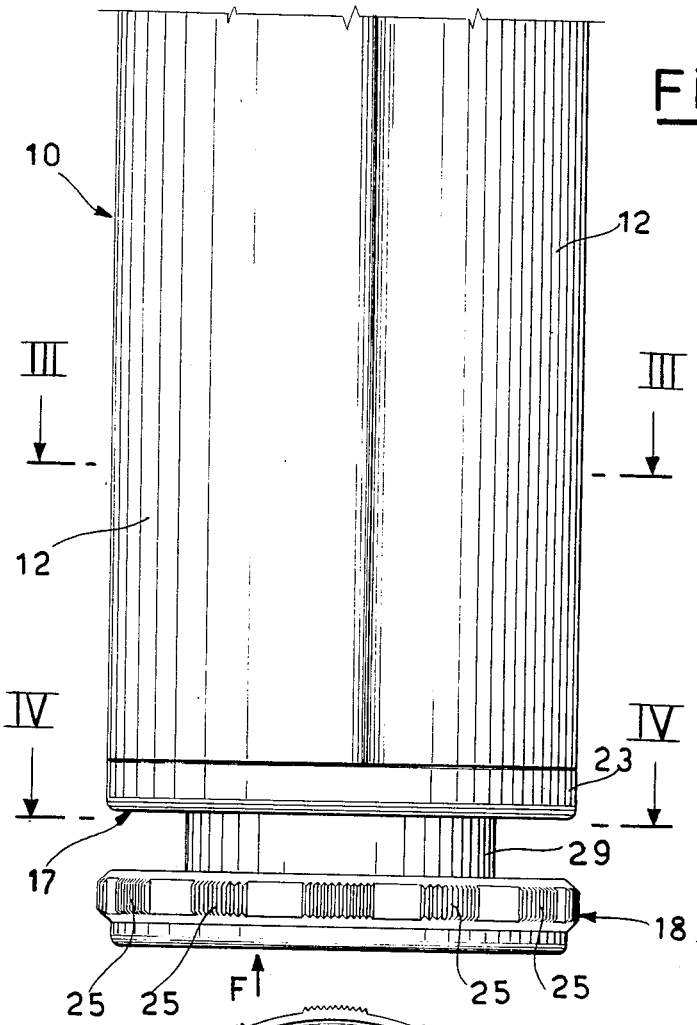
FIG. 1 is an elevation view showing part of a table leg according to the invention.
Figure 2:
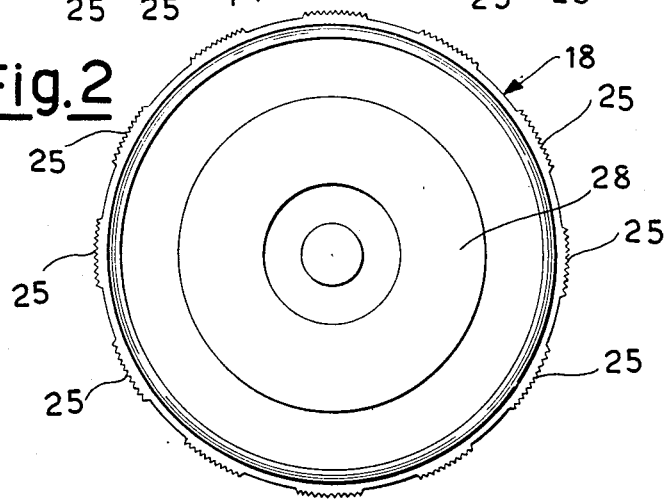
FIG. 2 is a view from the direction indicated by the arrow F.
Figure 3:
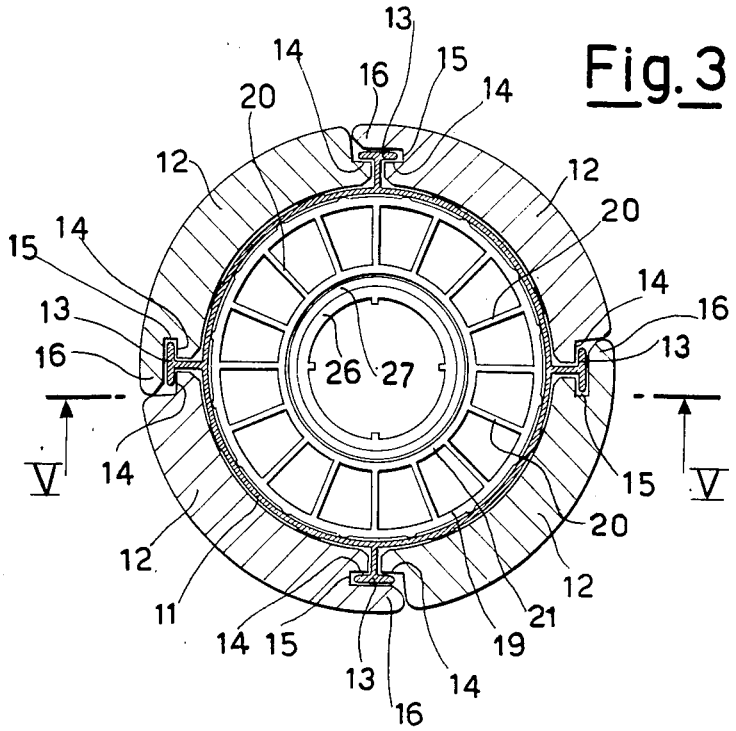
FIG. 3 is a section view taken along the line III—III of FIG. 1.
Figure 4:
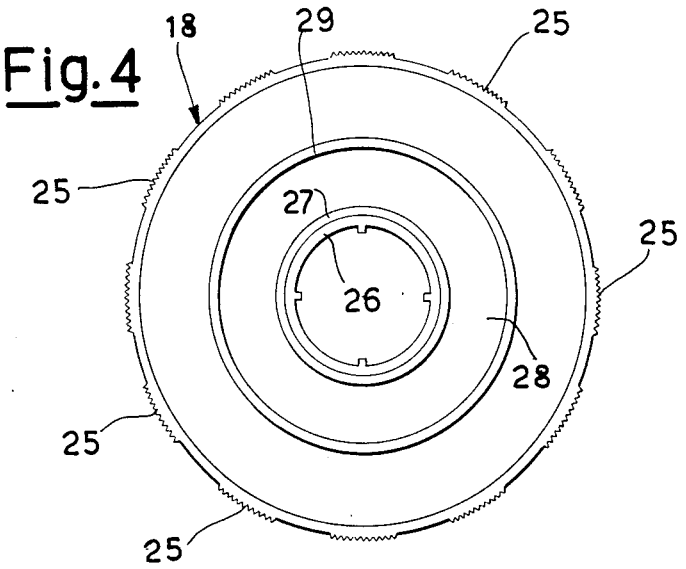
FIG. 4 is a section view taken along the line IV—IV of FIG. 1.

With reference to the drawings, the leg of the invention is generally indicated by the reference numeral 10 and is structurally formed by a load bearing central tubular core 11 upon which sheathing staves 12 are attached. The central core 11 is preferably a metal cylinder having a plurality of radially extending and peripherally spaced T-shaped elements; integrally formed on its outer surface as connection means for the staves 12. To this end one of the longitudinal edges of each stave 12 is step shaped at 14, and the other edge is similarly step shaped and is additionally provided with a groove 15 and an overlying limb 16. Each stave can therefore be inserted securely between two T-shaped elements 13, the latter being hidden by the limb 16 of the junction thus formed, which limb is in abutment against the step 14 of the adjacent stave.

Said leg 10 includes at its base a levelling means comprised of a female member 17 and a male member 18.

Figure 5:
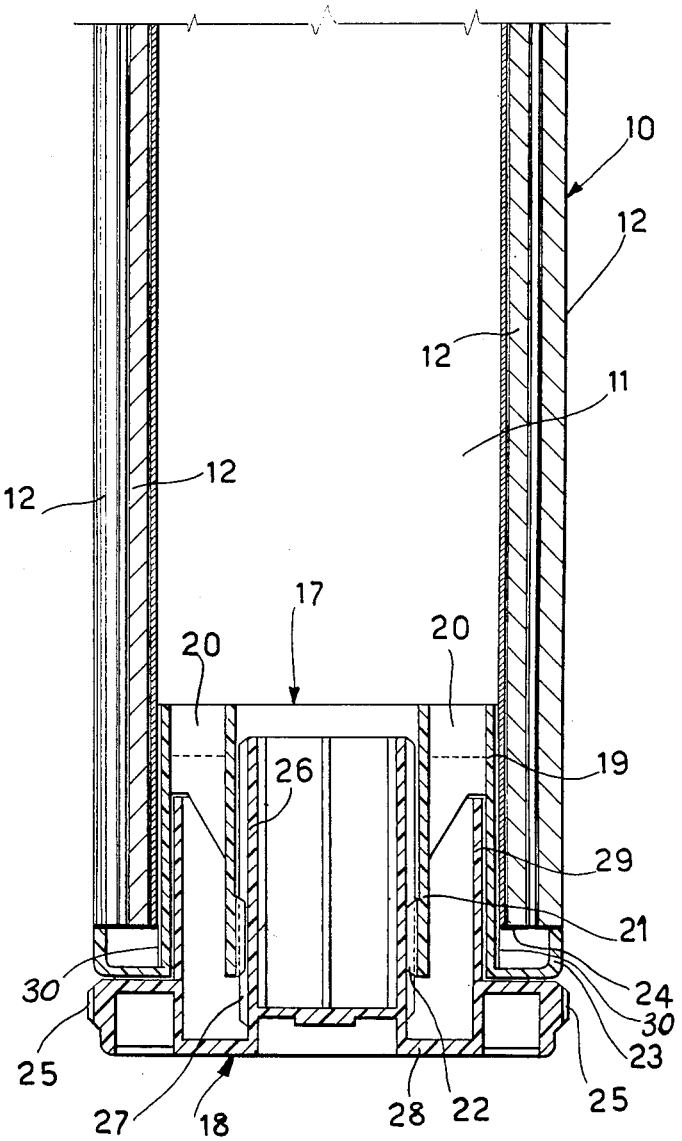
FIG. 5 is a section view taken along the line V—V of FIG. 3.

The female member 17 comprised of an external skirt 19 to which a central tubular element 21 is firmly connected by radial ribs 20. The element 21 is internally threaded at 22. Said skirt 19 is further provided with an annular rim 23 overlapping the bottom edge 24 of leg 10. Said female member 17 is firmly connected to the leg 10 by forced insertion of the skirt 19, the latter being provided to this end by a plurality of external longitudinal ribs 30 (Fig. 5).

The male member 18 is comprised of a central tubular part 26 with a threaded portion 27 adapted to be screwed into the thread 22. The tubular part projects from a base 28 having external longitudinal ribs 25 for gripping, and also a surrounding skirt 29 projects from the base 28, said skirt 29 mating inside the skirt 19.

It is thus evident that by screwing or unscrewing the male member 18 in or out respectively of the female member 17, it is possible to adjust the height of the leg and the stability of a table fitted with legs 10.

Both the central core 11 and the staves can be made of any suitable material, and also have any desired tubular box-like shape.

For example, the staves 12 can be advantageously made of a suitably shaped wood material, with an external surface finishing as desidered, for example by veneering, lacquer, varnish, etc.; said finishing may be applied quite easily by the purchaser of the leg and/or the table with the legs.

In the case of wood material staves, the limbs 16 will provide an efficient hiding of the underlying elements 13 also in case of shrinkages due to changes of ambient conditions.

I claim:

1. A table leg comprising a cylindrical load bearing central core, a plurality of longitudinal sheathing staves surrounding the outer surface of said core and connecting means for securing the staves to the core, said connecting means comprising a plurality of peripherally spaced, T-shaped segments integral with the core and projecting radially outward therefrom and complimentary shaped longitudinal edges on said staves for sliding insertion of the staves between said segments, the longitudinal edges of said staves being shaped so that the opposed abutting edges of two adjacent staves form a longitudinal T-shaped seat corresponding to the T-shape of said radially extending segments of said central core with one longitudinal edge of each stave having a limb that completely overlies the outer top of the T-shaped segments.

2. The table leg of claim 1, including, at one end of its leg, levelling means comprising a female member joined to said end of the leg and a male member adjustable relative to said female member by screw means.

3. The table leg of claim 2, wherein the female member has an annular skirt and the male member has an annular skirt that slides inside of said female skirt as the male member is adjusted relative to the female member.

* * * * *